US010372061B1

(12) United States Patent
Fuse

(10) Patent No.: US 10,372,061 B1
(45) Date of Patent: Aug. 6, 2019

(54) IMAGE FORMING SYSTEM, IMAGE FORMING METHOD, AND DETERMINATION APPARATUS

(71) Applicant: TOSHIBA TEC KABUSHIKI KAISHA, Shinagawa-ku, Tokyo (JP)

(72) Inventor: Hiroyuki Fuse, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/030,162

(22) Filed: Jul. 9, 2018

(51) Int. Cl.
*G03G 15/00* (2006.01)
*G03G 15/08* (2006.01)

(52) U.S. Cl.
CPC ..... *G03G 15/0863* (2013.01); *G03G 15/5075* (2013.01)

(58) Field of Classification Search
CPC ..... G03G 15/0863; G03G 15/55; G03G 15/5075; G03G 15/5091; G03G 21/1875; G03G 21/1892
See application file for complete search history.

(56) References Cited

U.S. PATENT DOCUMENTS

2004/0101320 A1* 5/2004 Haramoto ..... G03G 15/55 399/12
2011/0044703 A1 2/2011 Fuse
2018/0203377 A1* 7/2018 Wakamatsu ..... G03G 15/0863

* cited by examiner

*Primary Examiner* — Sophia S Chen
(74) *Attorney, Agent, or Firm* — Foley & Lardner LLP

(57) ABSTRACT

An image forming system includes an image forming unit, an acquisition unit, first and second determination units, and a controller. The image forming unit forms an image using toner from a toner cartridge. The acquisition unit acquires identification information from the toner cartridge. The first determination unit determines whether the toner cartridge satisfies a first condition, based on the identification information. The second determination unit determines whether a second condition is satisfied if a determination result of the first determination unit indicates that the toner cartridge does not satisfy the first condition. The controller enables the image forming unit to form an image, if the determination result of the first determination unit indicates that the toner cartridge satisfies a predetermined condition or that the toner cartridge does not satisfy the predetermined condition and if a determination result of the second determination unit indicates that the second condition is satisfied.

11 Claims, 18 Drawing Sheets

FIG. 11

910

911

| REGISTRATION ID | AUTHENTICATION SITUATION |
|---|---|
| AA1 | AUTHENTICATED |
| AA2 | NON-AUTHENTICATION |
| . . . | . . . |

IMAGE FORMING SYSTEM, IMAGE FORMING METHOD, AND DETERMINATION APPARATUS

FIELD

Embodiments described herein relate generally to an image forming system, an image forming method, and a determination apparatus.

BACKGROUND

In the related art, there is an image forming apparatus that forms an image with toner supplied from a toner cartridge attached to the image forming apparatus itself. The image forming apparatus performs genuine product determining for a toner cartridge attached to the image forming apparatus itself so as to maintain image quality and prevent the image forming apparatus from failing. The genuine product determining determines whether or not the toner cartridge is a genuine product. The image forming apparatus does not form an image if it is determined that the toner cartridge is not the genuine product as a result of the genuine product determining. The image forming apparatus cannot achieve both reduction in an opportunity of image formation performed by the toner cartridge which is not the genuine product and image formation performed by the toner cartridge which is not the genuine product. Accordingly, a user who intends to form an image using the image forming apparatus cannot form an image, and convenience of the user is reduced.

DESCRIPTION OF THE DRAWINGS

FIG. 11 is a diagram illustrating a specific example of authenticated genuine product information according to the second embodiment.

DETAILED DESCRIPTION

In general, according to at least one embodiment, an image forming system includes an image forming unit, an acquisition unit, a first determination unit, a second determination unit, and a control unit (a controller). The image forming unit forms an image by using toner that is supplied by a toner cartridge. The acquisition unit acquires identification information from the toner cartridge. The first determination unit determines whether or not the toner cartridge satisfies a first condition, based on the identification information. The second determination unit determines whether or not a second condition is satisfied if a determination result of the first determination unit indicates that the toner cartridge does not satisfy the first condition. The control unit enables the image forming unit to form an image, if a determination result of the first determination unit indicates that the toner cartridge satisfies a predetermined condition, or if the determination result of the first determination unit indicates that the toner cartridge does not satisfy the predetermined condition, and if a determination result of the second determination unit indicates that the second condition is satisfied.

First Embodiment

Figure 1:
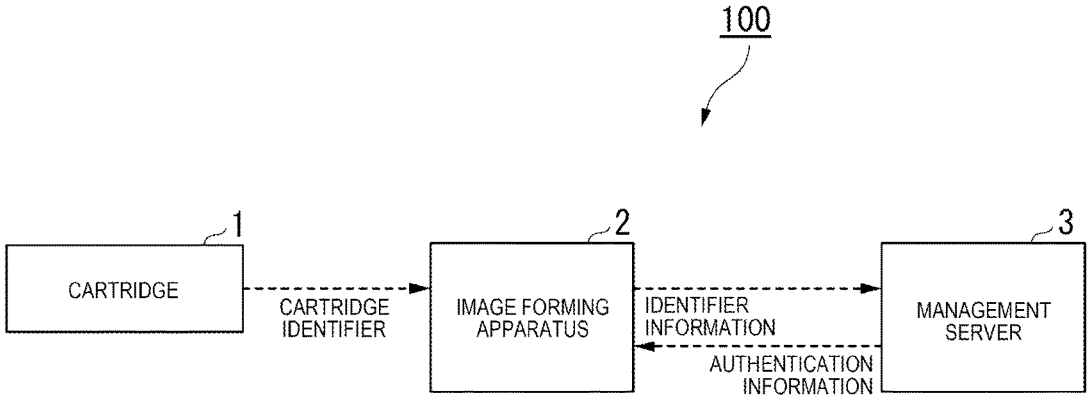
FIG. 1 is a diagram illustrating a specific system configuration of an image forming system according to a first embodiment.

FIG. 1 is a diagram illustrating a specific system configuration of an image forming system 100 according to a first embodiment.

The image forming system 100 includes a cartridge 1, an image forming apparatus 2, and a management server 3.

The cartridge 1 is detachably attached to the image forming apparatus 2 and supplies toner to the image forming apparatus 2.

The image forming apparatus 2 forms an image using the toner supplied by the cartridge 1. The image forming apparatus 2 acquires an identifier (hereinafter, referred to as a "cartridge identifier") for identifying the cartridge 1. The image forming apparatus 2 transmits information (hereinafter, referred to as "identifier information") indicating the acquired cartridge identifier to the management server 3.

The management server 3 manages the image forming apparatus 2. The management server 3 receives the identifier information transmitted by the image forming apparatus 2 and manages the image forming apparatus 2, based on the cartridge identifier indicated by the received identifier information. The management server 3 acquires the identifier information, performs authenticating, and generates authentication information according to results of the processing. The authenticating is processing in which the management server 3 determines whether or not the identifier information indicates a cartridge identifier of a genuine product. The genuine product is the cartridge 1 that satisfies a predetermined condition. The predetermined condition may be any condition. The predetermined condition may be, for example, a condition in which the cartridge identifier indicates the toner cartridge 1 previously registered in the management server 3. The authentication information indicates an instruction based on results of the authenticating. Specifically, the authentication information indicates one of the following three instructions. One instruction is an instruction (hereinafter, referred to as a "permission instruction") which does not prohibit an image from being formed by the image forming apparatus 2. Another instruction is an instruction (hereinafter, referred to as a "temporary permission instruction") that permits image formation performed by the image forming apparatus 2 only for a predetermined period of time. The other instruction is an instruction (hereinafter, referred to as a "prohibition to instruction") that prohibits an image from being formed by the image forming apparatus 2.

Figure 2:
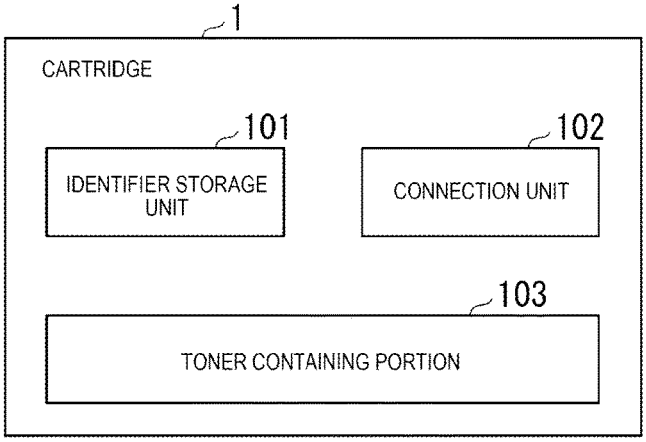
FIG. 2 is a diagram illustrating a specific functional configuration of a cartridge according to the first embodiment.

FIG. 2 is a diagram illustrating a specific functional configuration of the cartridge 1 according to the first embodiment.

The cartridge 1 includes an identifier storage unit (a storage) 101, a connection unit 102, and a toner containing portion 103.

The identifier storage unit 101 is configured by using a storage device such as a semiconductor memory device. The identifier storage unit 101 stores a cartridge identifier.

The connection unit 102 includes a communication interface for connecting the cartridge 1 to the image forming apparatus 2. The connection unit 102 communicates with the image forming apparatus 2 via a communication line.

The toner containing portion 103 contains toner.

Figure 3:
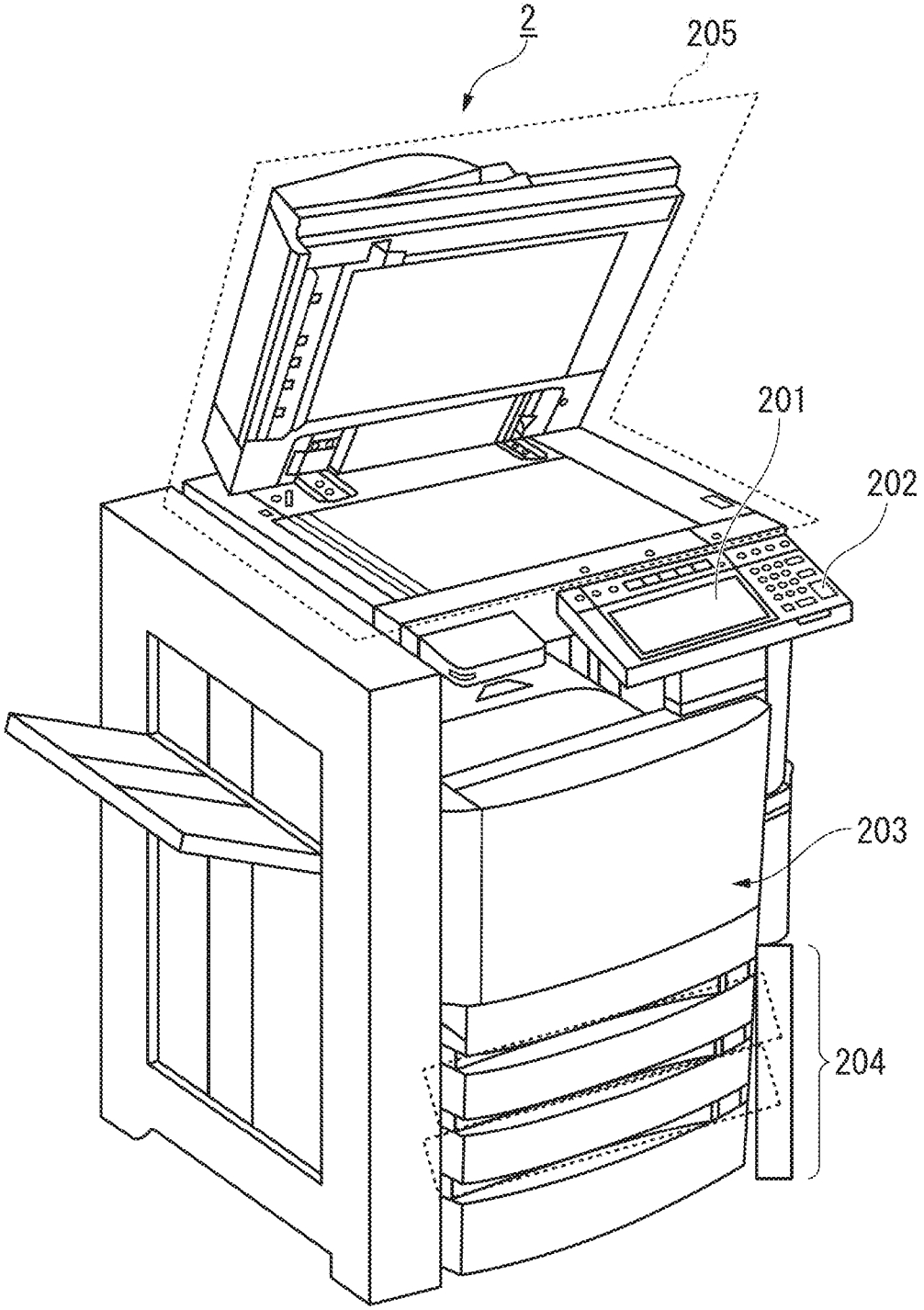
FIG. 3 is an external view illustrating the entire configuration example of an image forming apparatus according to the first embodiment.

FIG. 3 is an external view illustrating the entire configuration example of the image forming apparatus 2 according to the first embodiment. The image forming apparatus 2 is, for example, a multifunction peripheral. The image forming apparatus 2 includes a display 201, a control panel 202, an image forming unit 203, a sheet containing portion 204, and an image reading unit 205. The image forming unit 203 of the image forming apparatus 2 may be an apparatus that fixes a toner image or may be an apparatus of an ink jet type.

The display 201 is an image display device such as a liquid crystal display, or an organic electro luminescence (EL) display. The display 201 displays various types information relating to the image forming apparatus 2.

The control panel 202 includes a plurality of buttons. The control panel 202 receives an operation of a user. The control panel 202 outputs a signal according to the operation performed by the user to a control unit of the image forming apparatus 2. The display 201 and the control panel 202 may be configured as an integral touch panel.

The image forming unit 203 forms an image on a sheet, based on image information generated by the image reading unit 205 or image information received via the communication line. The image forming unit 203 forms an image through, for example, the following processing. The image forming portion of the image forming unit 203 forms an electrostatic latent image on a photoconductive drum, based on the image information. The image forming portion of the image forming unit 203 forms a visible image by attaching a developer to an electrostatic latent image. The toner is a specific example of the developer. A transfer unit of the image forming unit 203 transfers the visible image formed by the toner onto the sheet. A fixing unit of the image forming unit 203 heats and pressurizes a sheet to which the toner is transferred, thereby, fixing the visible image formed by the toner onto the sheet. The sheet on which an image is formed may be a sheet contained in the sheet containing portion 204 or may be a sheet held by a hand.

The sheet containing portion 204 contains a sheet to be used for forming an image in the image forming unit 203.

The image reading unit 205 reads image information to be read as light and dark of light. The image reading unit 205 records the read image information. The recorded image information may be transmitted to another information processing apparatus via a communication line such as a network. The recorded image information may be formed on the sheet by the image forming unit 203.

Figure 4:
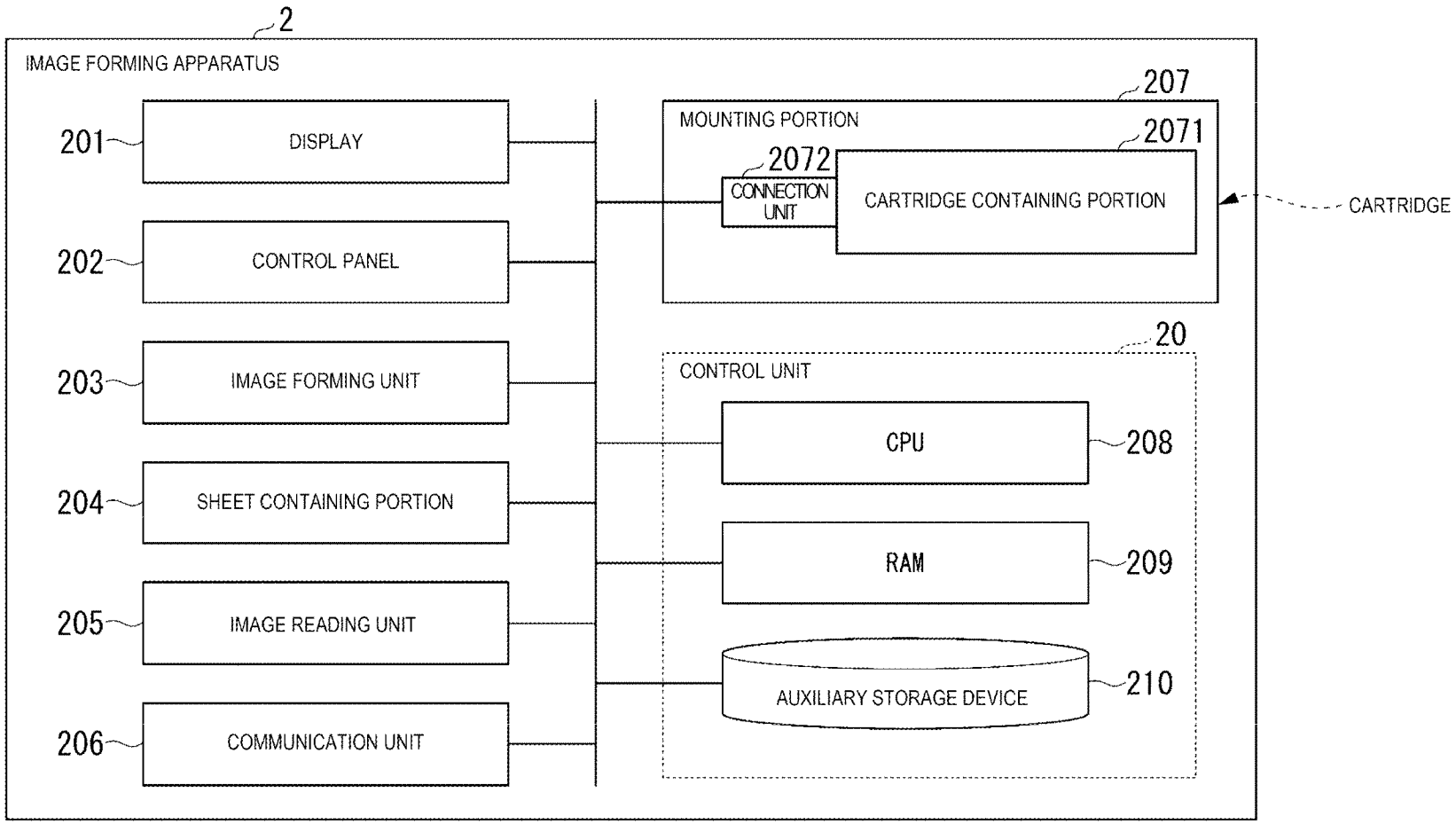
FIG. 4 is diagram illustrating a specific example of a hardware configuration of the image forming apparatus according to the first embodiment.

FIG. 4 is a diagram illustrating a specific example of a hardware configuration of the image forming apparatus 2 according to the first embodiment. The image forming apparatus 2 includes the display 201, the control panel 202, the image forming unit 203, the sheet containing portion 204, the image reading unit 205, a communication unit 206, a mounting portion 207, a central processing unit (CPU) 208, a random access memory (RAM) 209, and an auxiliary storage device 210, which are connected to each other by a bus. The CPU 208 reads a program stored in the auxiliary storage device 210 into the RAM 209 to execute the program, and thereby, the control unit 20 is generated. The control unit 20 controls the display 201, the control panel 202, the image forming unit 203, the sheet containing portion 204, the image reading unit 205, the communication unit 206, and the mounting portion 207.

Hereinafter, elements having the same functions as the elements illustrated in FIG. 3 are denoted by the same reference numerals or symbols, and description thereof will be omitted.

The communication unit 206 includes a communication interface for connecting the image forming apparatus 2 to the management server 3 and an external device. The communication unit 206 communicates with the management server 3 and the external device via a communication line.

The mounting portion 207 includes a cartridge containing portion 2071 and a connection unit 2072. The cartridge containing portion 2071 includes an opening and detachably contains the cartridge 1 inserted through the opening.

The connection unit 2072 includes a communication interface for connecting the image forming apparatus 2 to the cartridge 1. The connection unit 2072 communicates with the cartridge 1 contained in the cartridge containing portion 2071 via the communication line and the connection unit 102.

The auxiliary storage device 210 is configured by using a nonvolatile memory device such as a magnetic hard disk device or a semiconductor memory device. The auxiliary storage device 210 stores mounting cartridge information and state information. The mounting cartridge information indicates a cartridge identifier of the cartridge 1 mounted in the image forming apparatus 2. The state information indicates a state relating to image formation performed by the image forming apparatus 2. Specifically, the state information indicates one of a possible state, a temporary possible state and an impossible state. The possible state is a state in which an image can be formed by the image forming apparatus 2. The image forming apparatus 2 in a state where an image can be formed forms an image if an instruction to form an image is input to the image forming apparatus 2. The temporarily possible state is a state where image formation performed by the image forming apparatus 2 is possible for a predetermined period of time. The impossible state is a state where image formation performed by the image forming apparatus 2 is impossible. The image forming apparatus 2 in a state where an image cannot be formed does not form an image even if the instruction to form an image is input to the image forming apparatus 2.

Figure 5:
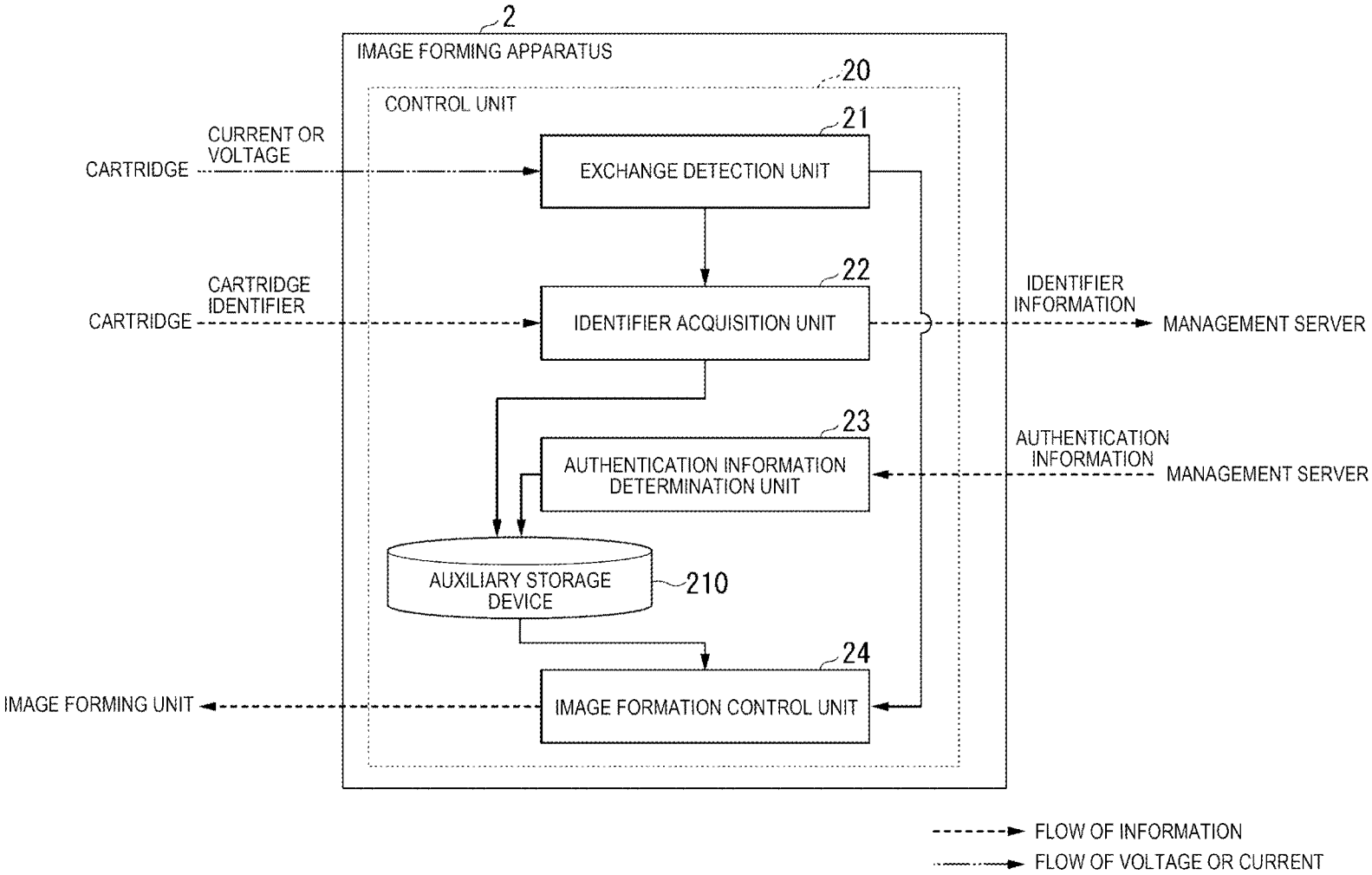
FIG. 5 is a diagram illustrating a specific example of a functional configuration of a main part of the image forming apparatus according to the first embodiment.

FIG. 5 is a diagram illustrating a specific example of a functional configuration of a main part of the image forming apparatus 2 according to the first embodiment. The image forming apparatus 2 includes an exchange detection unit 21, an identifier acquisition unit 22, an authentication information determination unit 23, and an image formation control unit 24.

The exchange detection unit 21 detects that the cartridge 1 is previously contained in the cartridge containing portion 2071. The exchange detection unit 21 is an electronic circuit which is electrically connected to the connection unit 2072 and includes an electronic component that satisfies a predetermined condition. The electrical connection may be not only a wired connection but also a wireless connection. The predetermined condition is a condition in which a predetermined voltage or current is applied to an electronic component, if the connection unit 102 is electrically connected to the connection unit 2072. The exchange detection unit 21 generates a connection signal if the predetermined voltage or current is applied to an electronic component satisfying a predetermined condition. The connection signal indicates that the cartridge 1 is connected to the image forming apparatus 2. The exchange detection unit 21 may not be limited to an electronic circuit, and may be an electric circuit or an optical circuit.

The identifier acquisition unit 22 acquires the cartridge identifier stored in the identifier storage unit 101 via the connection unit 102 of the cartridge 1. The identifier acquisition unit 22 compares the cartridge identifier indicated by the mounting cartridge information previously stored in the auxiliary storage device 210 with the acquired cartridge identifier. If two identifiers do not coincide with each other, the identifier acquisition unit 22 transmits the cartridge identifier obtained via the connection unit 102 of the cartridge 1 to the management server 3. In addition, if the two identifiers do not coincide with each other, the identifier acquisition unit 22 overwrites the cartridge identifier obtained via the connection unit 102 of the cartridge 1 onto the cartridge identifier which is stored in the auxiliary storage device 210 and is indicated by the mounting cartridge information. In addition, the identifier acquisition unit 22 overwrites a value indicating the impossible state onto a value of the state information stored in the auxiliary storage device 210.

The authentication information determination unit 23 acquires authentication information transmitted by the management server 3 via the communication unit 206, and determines a state indicated by the acquired authentication information. Specifically, the authentication information determination unit 23 determines which one of a permission instruction, a temporary permission instruction, and a prohibition instruction is indicated by the acquired authentication information.

The authentication information determination unit 23 overwrites a value corresponding to the determination result onto a value of the state information stored in the auxiliary storage device 210. Specifically, if the authentication information indicates the permission instruction, the authentication information determination unit 23 overwrites a value indicating the possible state onto the value of the state information. If the authentication information indicates the temporary permission instruction, the authentication information determination unit 23 overwrites a value indicating the temporary possible state onto the value of the state information. If the authentication information indicates the non-permission instruction, the authentication information determination unit 23 overwrites a value indicating the impossible state onto the value of the state information.

The image formation control unit 24 controls the image forming unit 203, based on the state information stored in the auxiliary storage device 210.

Figure 6:
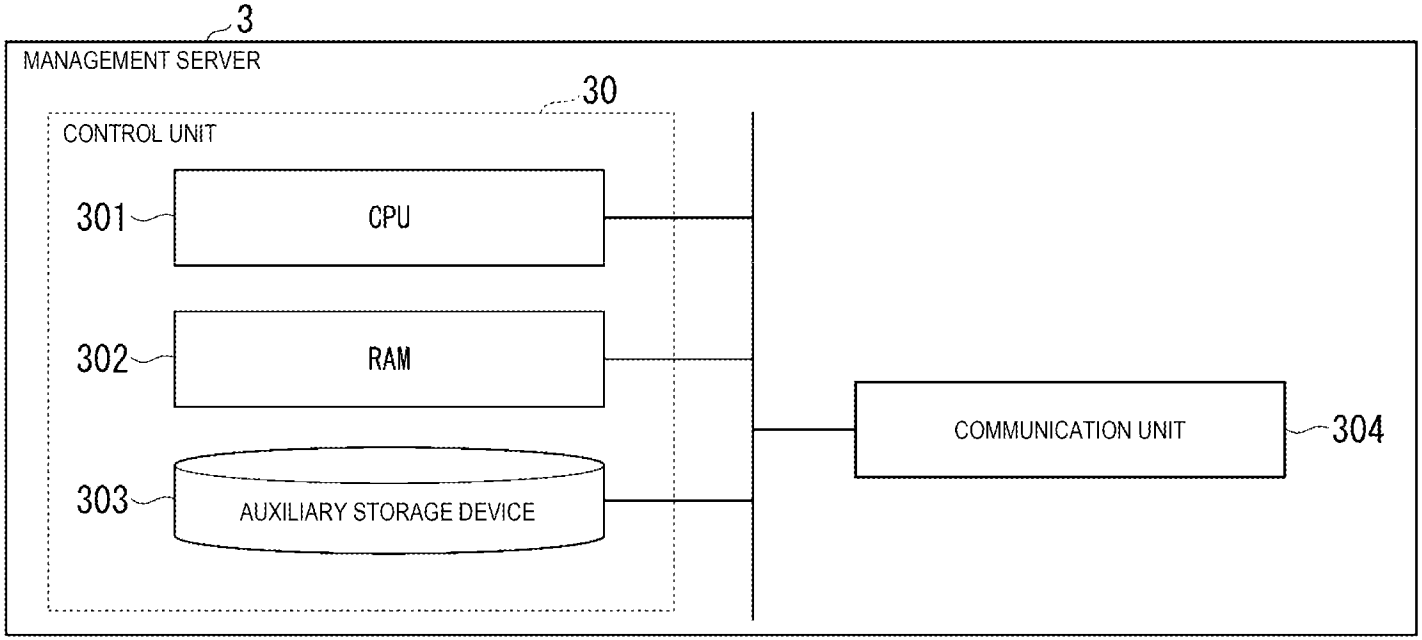
FIG. 6 is a diagram illustrating a specific example of a hardware configuration of a management server according to the first embodiment.

FIG. 6 is a diagram illustrating a specific example of a hardware configuration of the management server 3 according to the first embodiment. The management server 3 includes a central processing unit (CPU) 301, a random access memory (RAM) 302, an auxiliary storage device 303, and a communication unit 304 which are connected to each other by a bus. The CPU 301 reads a program stored in the auxiliary storage device 303 into the RAM 302 to execute the program, and thereby, the control unit 30 is generated. The control unit 30 controls the communication unit 304.

The auxiliary storage device 303 is configured by using a nonvolatile memory device such as a magnetic hard disk device or a semiconductor memory device. The auxiliary storage device 303 stores the cartridge identifier.

The communication unit 304 includes a communication interface for connecting the management server 3 to the image forming apparatus 2. The communication unit 304 communicates with the image forming apparatus 2 via a communication line.

Figure 7:
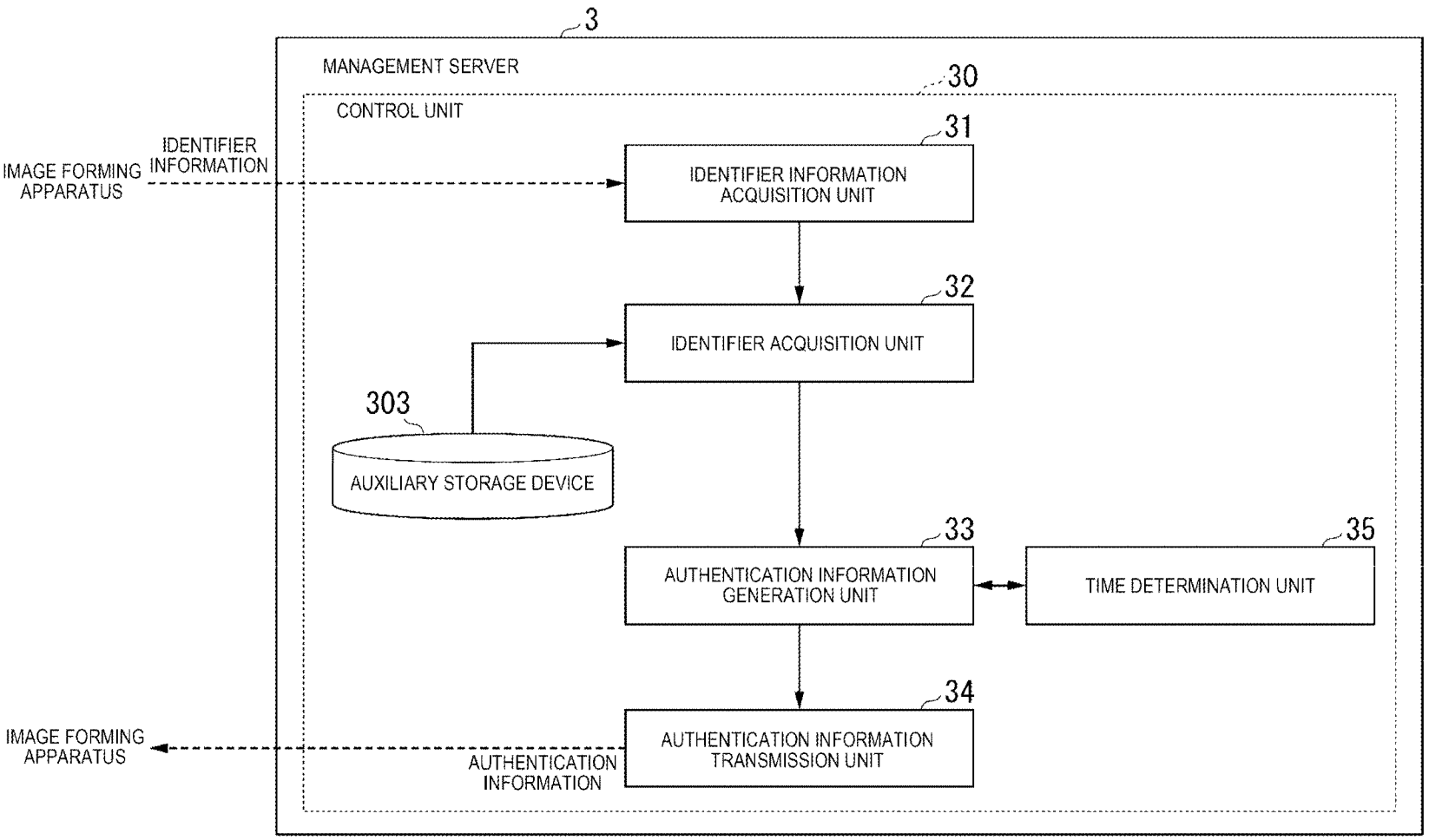
FIG. 7 is a diagram illustrating a specific example of a functional configuration of a main part of the management server according to the first embodiment.

FIG. 7 is a diagram illustrating a specific example of a functional configuration of a main part of the management server 3 according to the first embodiment.

The management server 3 includes an identifier information acquisition unit 31, an identifier determination unit 32, an authentication information generation unit 33, an authentication information transmission unit 34, and a time determination unit 35.

The identifier information acquisition unit 31 acquires the identifier information transmitted by the image forming apparatus 2 via the communication unit 304.

The identifier determination unit 32 performs genuine product determining. The genuine product determining determines whether or not the cartridge identifier indicated by the identifier information acquired by the identifier information acquisition unit 31 is a cartridge identifier of a genuine product.

The authentication information generation unit 33 generates any one of authentication information indicating a permission instruction, authentication information indicating a temporary permission instruction, and authentication information indicating a prohibition instruction, based on the determination result of the identifier determination unit 32. If a determination result of the identifier determination unit 32 is not a cartridge identifier genuine product, the authentication information generation unit 33 generates the authentication information indicating the temporary permission instruction. If the authentication information indicating the temporary permission instruction is generated, the authentication information generation unit 33 generates the authentication information indicating the prohibition instruction when a predetermined condition is satisfied.

The authentication information transmission unit 34 acquires the authentication information generated by the authentication information generation unit 33, and transmits the authentication in information generated by the authentication information generation unit 33 to the image forming apparatus 2 via the communication unit 304.

The time determination unit 35 determines whether or not a predetermined time elapses after the authentication information indicating the temporary permission instruction is generated.

Figure 8:
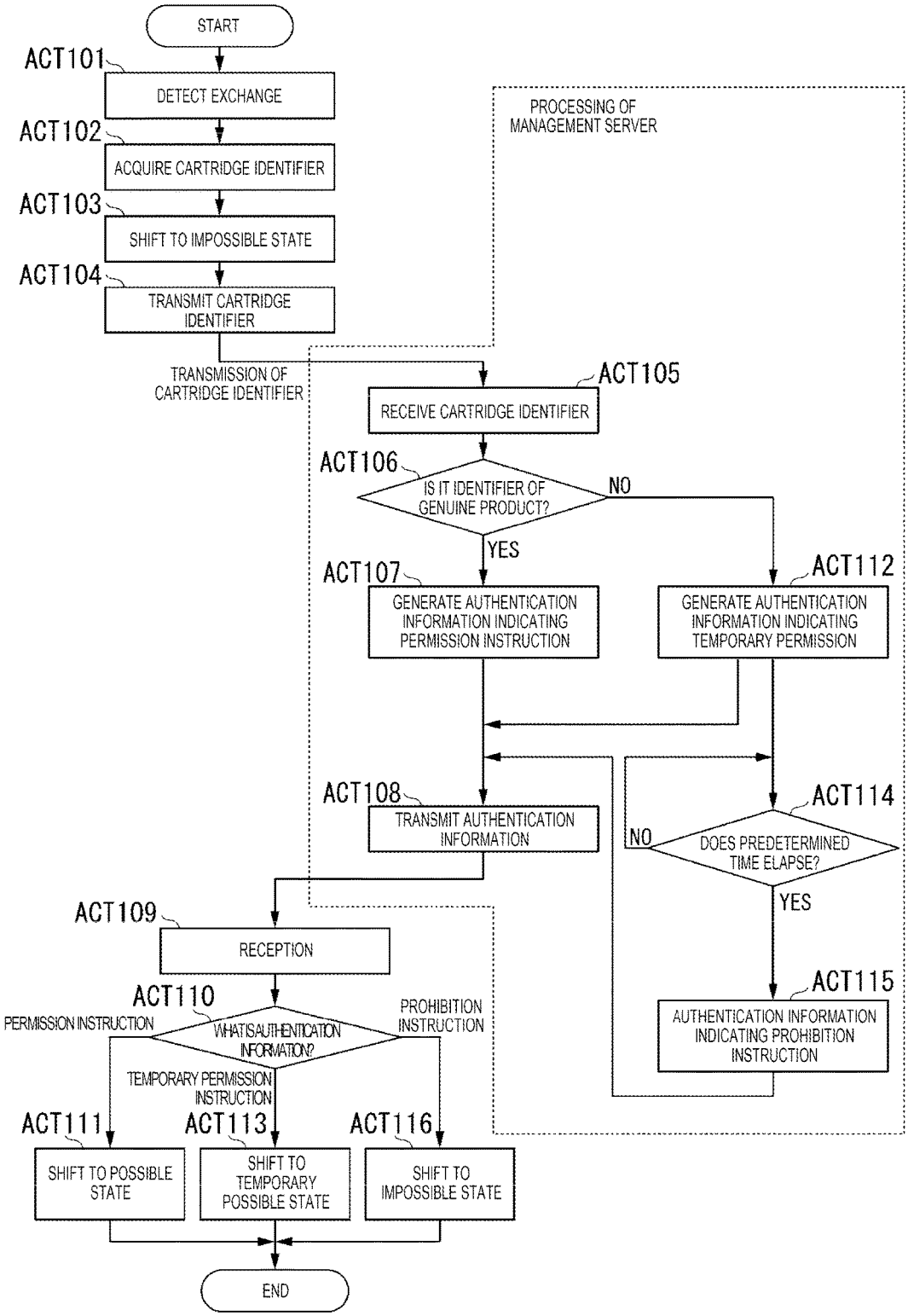
FIG. 8 is a flowchart illustrating a specific example of a flow of processing when replacing a cartridge in the image forming system according to the first embodiment.

FIG. 8 is a flowchart illustrating a specific example of a flow of processing when the cartridge in the image forming system 100 according to the first embodiment is exchanged.

The exchange detection unit 21 detects that the cartridge 1 is contained in the cartridge containing portion 2071 (ACT 101). The exchange detection unit 21 transmits a connection signal to the identifier acquisition unit 22. The identifier acquisition unit 22 in which the connection signal is acquired reads a cartridge identifier from the identifier storage unit 101 included in the cartridge (ACT 102). The identifier acquisition unit 22 does not transmit a signal indicating that the cartridge identifier is acquired to the cartridge 1. The identifier acquisition unit 22 sets the value of the state information stored in the auxiliary storage device 210 to the value indicating the impossible state. The image formation control unit 24 acquires the value of the state information stored in the auxiliary storage device 210 and shifts to the impossible state (ACT 103). The identifier acquisition unit 22 transmits the identifier information indicating the cartridge identifier to the management server 3 (ACT 104). The identifier information acquisition unit 31 acquires the identifier information transmitted by the identifier acquisition unit 22 (ACT 105). The identifier determination unit 32 performs genuine product determining for the cartridge identifier indicated by the acquired identifier information. By performing the genuine product determining (a first determination), the identifier determination unit 32 determines whether or not the cartridge identifier indicated by the identifier information is the cartridge identifier of a genuine product (ACT 106). If the cartridge identifier indicated by the identifier information is the cartridge identifier of a genuine product (ACT 106: YES), the authentication information generation unit 33 generates the authentication information indicating the permission instruction (ACT 107). The authentication information transmission unit 34 transmits the authentication information indicating the permission instructions to the image forming apparatus 2 (ACT 108). The authentication information determination unit 23 of the image forming apparatus 2 acquires the authentication information transmitted by the authentication information transmission unit 34 in the ACT 108 (ACT 109). The authentication information determination unit 23 determines which of the permission instruction, the temporary permission instruction, and the prohibition instruction is indicated by the acquired authentication information (ACT 110). If the authentication information indicates the permission instruction (ACT 110: permission instruction), the authentication information determination unit 23 overwrites the value indicating the possible state onto the value of the state information stored in the auxiliary storage device 210. The image formation control unit 24 acquires the value of the state information stored in the auxiliary storage device 210 and shifts to the possible state (ACT 111).

Meanwhile, in ACT 106, if the cartridge identifier indicated by the identifier information is not the cartridge identifier of a genuine product (ACT 106: NO), the authentication information generation unit 33 generates the authentication information indicating the temporary permission instruction (ACT 112). The authentication information transmission unit 34 transmits the authentication information indicating the temporary permission instruction to the image forming apparatus 2 (ACT 108). The authentication information determination unit 23 of the image forming apparatus 2 acquires the authentication information transmitted by the authentication information transmission unit 34 in the ACT 108 (ACT 109). The authentication information determination unit 23 determines which of the permission instruction, the temporary permission instruction, and the prohibition instruction is indicated by the acquired authentication information (ACT 110). If the authentication information indicates the temporary permission instruction (ACT 110: temporary permission instruction), the authentication information determination unit 23 overwrites the value indicating the temporary possible state onto the value of the state information stored in the auxiliary storage device 210. The image formation control unit 24 acquires the value of the state information stored in the auxiliary storage device 210 and shifts to the temporarily possible state (ACT 113).

In the ACT 112, after the authentication information generation unit 33 generates the authentication information indicating the temporary permission instruction, the time determination unit 35 periodically performs elapse time determining (a second determination). The elapse time determining determines whether or not a predetermined time elapses after the authentication information indicating the temporary permission instruction is generated (ACT 114). If it is determined that the predetermined time elapsed as a result of the elapse time determining (ACT 114: YES), the authentication information generation unit 33 generates the authentication information indicating the prohibition instruction (ACT 115). Next, the authentication information transmission unit 34 transmits the authentication information indicating the prohibition instruction (ACT 108). When it is determined that the predetermined time does not elapse as the result of the elapse time determination process (ACT 114: NO), the elapse time determining is periodically repeated thereafter. The authentication information determination unit 23 of the image forming apparatus 2 acquires the authentication information transmitted by the authentication information transmission unit 34 in the ACT 108 (ACT 109). The authentication information determination unit 23 determines which of the permission instruction, the temporary permission instructions and the prohibition instruction is indicated by the acquired authentication information (ACT 110). If the authentication information indicates the prohibition instruction (ACT 110: prohibition instruction), the authentication information determination unit 23 overwrites a value indicating the impossible state onto the value of the state information stored in the auxiliary storage device 210. The image formation control unit 24 shifts to the impossible state (ACT 116).

The image forming system 100 configured as described above can form an image using the image forming apparatus 2 within a predetermined period, even if the cartridge 1 is not a genuine product. Accordingly, the image forming system 100 configured as described above can maintain image quality and prevent the image forming apparatus from failing, and can improve convenience of a user.

Second Embodiment

Figure 9:
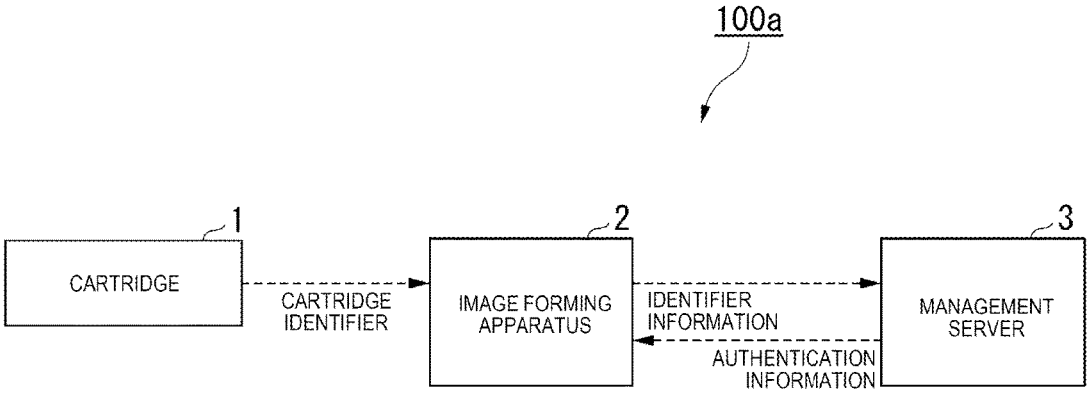
FIG. 9 is a diagram illustrating a specific system configuration diagram of an image forming system according to a second embodiment.

FIG. 9 is a diagram illustrating a specific system configuration of an image forming system 100*a* according to a second embodiment. Hereinafter, functional units having the same functions as the functional units illustrated in FIG. 1 are denoted by the same reference numerals or symbols, and description thereof will be omitted.

The image forming system 100*a* is different from the image forming system 100 in that a management server 3*a* is provided instead of the management server 3.

The management server 3*a* manages the image forming apparatus 2. The management server 3*a* receives the identifier information transmitted by the image forming apparatus 2 and manages the image forming apparatus 2, based on the cartridge identifier indicated by the received identifier information. The management server 3*a* acquires the identifier information and generates authentication information corresponding to the identifier information. The management server 3*a* controls image formation performed by the image forming apparatus 2 by transmitting the authentication information to the image forming apparatus 2.

Figure 10:
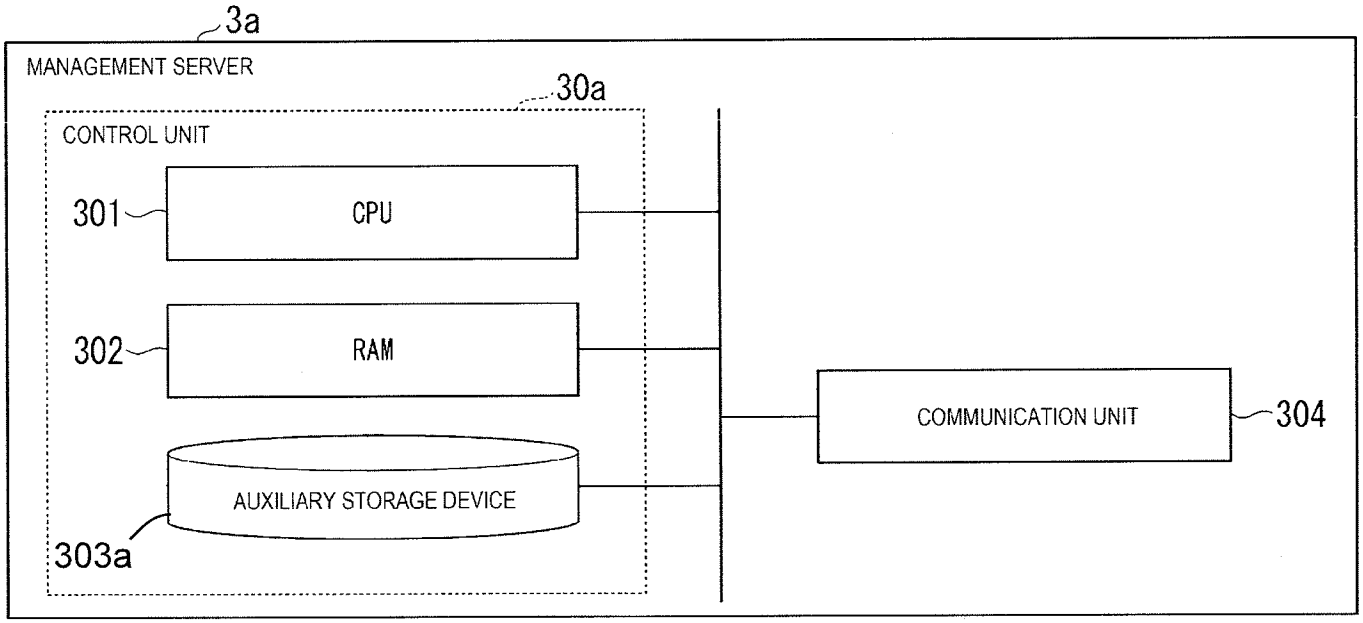
FIG. 10 is a diagram illustrating a specific example of a hardware configuration of a management server according to the second embodiment.

FIG. 10 is a diagram illustrating a specific example of a hardware configuration of the management server 3*a* according to the second embodiment. The management server 3*a* is different from the management server 3 in that an auxiliary storage device 303*a* is provided instead of the auxiliary storage device 303 and the control unit 30*a* is provided instead of the control unit 30. Hereinafter, functional units having the same functions as the functional units illustrated in FIG. 6 are denoted by the same reference numerals or symbols, and description thereof will be omitted.

The auxiliary storage device 303*a* is different from the auxiliary storage device 303 in that authenticated genuine product information is further stored in addition to the cartridge identifier of a genuine product. The authenticated genuine product information indicates the cartridge 1 in which authenticating is previously performed by the management server 3.

FIG. 11 is a diagram illustrating a specific example of the authenticated genuine product information, according to the second embodiment. The authenticated genuine product information is stored in the auxiliary storage device 303*a* as, for example, an authenticated genuine product information table 910 illustrated in FIG. 11. The authenticated genuine product information table 910 includes records for each "registration ID". Each record include each value of a "registration ID" and an "authentication situation". The "registration ID" indicates a cartridge identifier of a genuine product. The "authentication situation" indicates whether or not the cartridge 1 is previously used. The "authentication situation" includes values indicating "authenticated" and "non-authentication". The "authenticated" indicates that authenticating for the cartridge identifier of the cartridge 1 indicated by the "registration ID" is previously performed. The "non-authentication" indicates that the authenticating for the cartridge identifier of the cartridge 1 indicated by the "registration ID" is not performed. A record 911 indicates that the authenticating for the cartridge identifier of the cartridge 1 whose cartridge identifier is previously "AA1" is previously performed.

Figure 12:
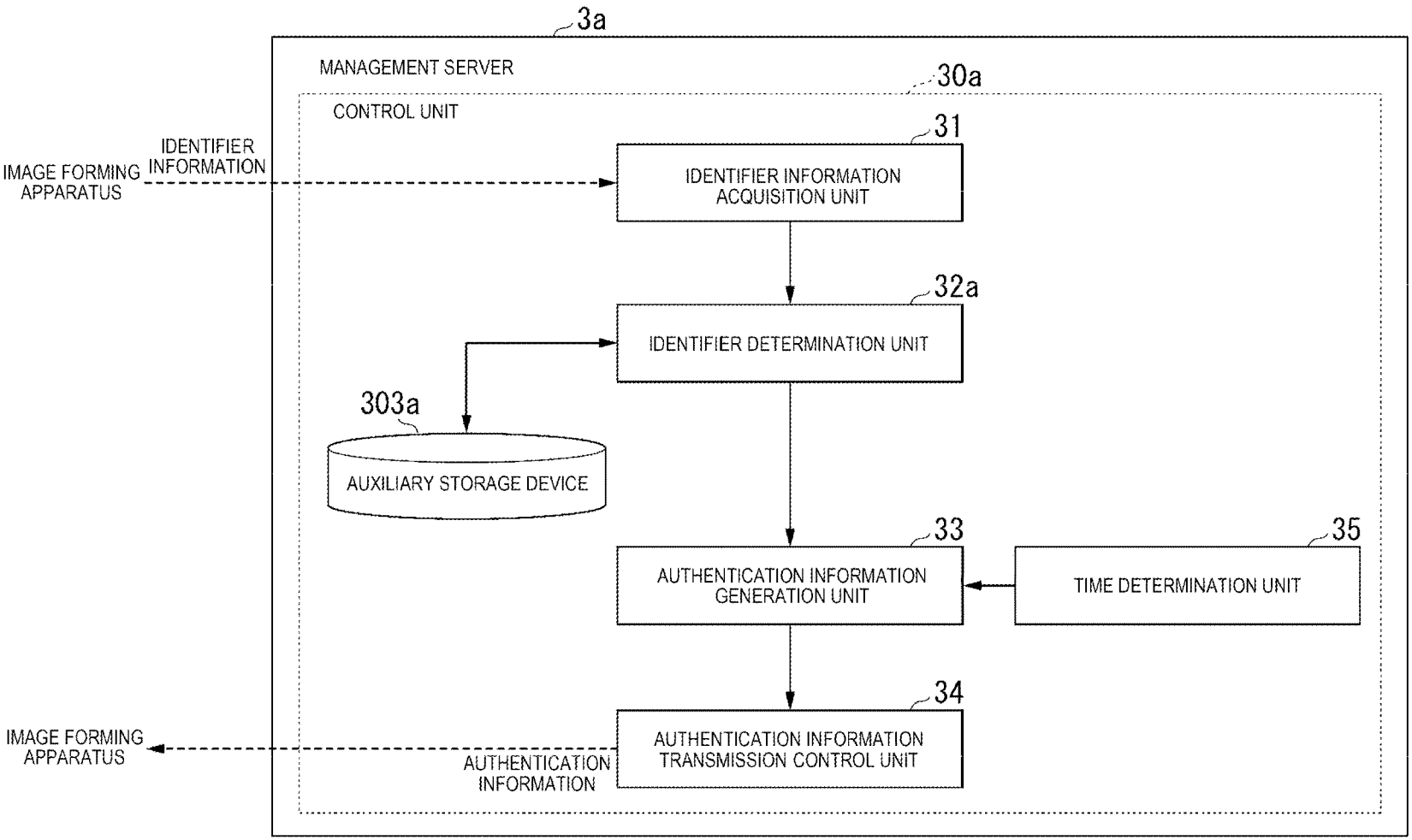
FIG. 12 is a diagram illustrating a specific example of a functional configuration of a main part of the management server according to the second embodiment.

FIG. 12 is a diagram illustrating a specific example of a functional configuration of a main part of the management server 3*a*, according to the second embodiment. Hereinafter, functional units having the same functions as the functional units illustrated in FIG. 7 are denoted by the same reference numerals or symbols, and description thereof will be omitted.

The management server 3*a* is different from the identifier determination unit 32 in that an identifier determination unit 32*a* is included instead of the identifier determination unit 32. The identifier determination unit 32*a* performs genuine product determining and authenticated determining. The authenticated determining determines whether or not the cartridge identifier is an identifier for which the authenticating is previously performed.

Figure 13:
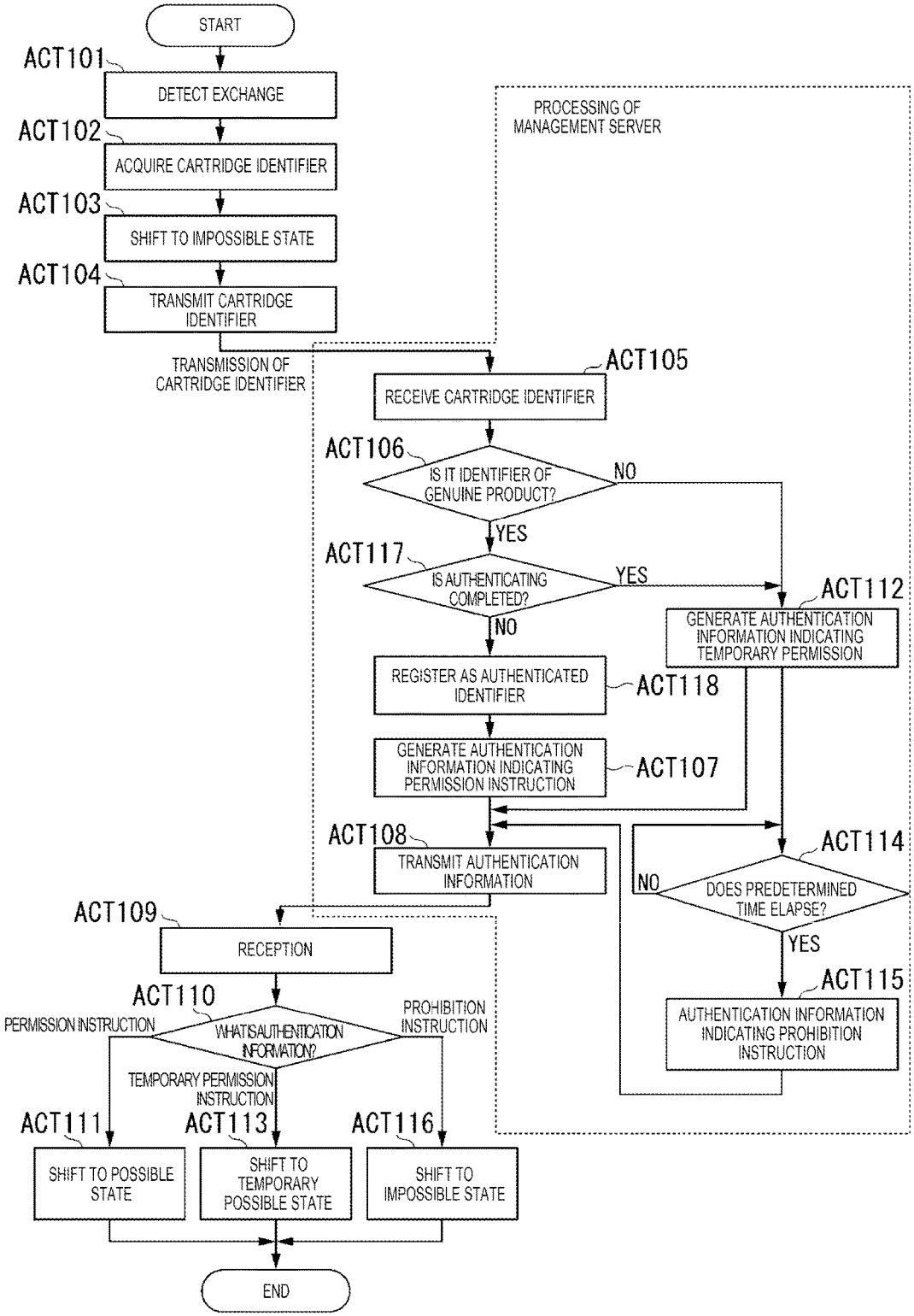
FIG. 13 is a flowchart illustrating a specific example of a flow of processing when replacing a cartridge in the image forming system according to the second embodiment.

FIG. 13 is a flowchart illustrating a specific example of a flow of processing when the cartridge in the image forming system 100*a* according to the second embodiment is exchanged. Hereinafter, the same reference numerals or symbols are attached to the same processing as the processing illustrated in FIG. 8, and the description thereof will be omitted.

Processing of FIG. 13 is different from the processing of FIG. 8 in that processing of ACT 117 and ACT 118 is included.

In ACT 106, if the cartridge identifier indicated by the identifier information is a cartridge identifier of a genuine product (ACT 106: YES), the identifier determination unit 32*a* performs the a authenticated determining (ACT 117). By performing the authenticated determining, the identifier determination unit 32*a* determines whether or not a target identifier is a cartridge identifier for which the authenticating is previously performed. The target identifier is the cartridge identifier acquired in ACT 105. Specifically, the identifier determination unit 32*a* refers to the authenticated genuine product information table 910 stored in the auxiliary storage device 303*a*. The identifier determination unit 32*a* selects a record in which the "registration ID" in the authenticated genuine product information table 910 is an example of a target identifier. The identifier determination unit 32*a* acquires a value indicated by the "authentication situation" of the selected record. If the acquired value is a value indicating the "authenticated", the identifier determination unit 32*a* determines that the target identifier is the cartridge identifier for which the authenticating is already performed. If the acquired value is a value indicating the "non-authentication", the identifier determination unit 32*a* determines that the target identifier is a cartridge identifier for which the authenticating is not performed yet. In ACT 117, if the determination result indicates that the target identifier is not the cartridge identifier for which the authenticating is previously performed (ACT 117: NO), the identifier determination unit 32*a* records the target identifier in the auxiliary storage device 303*a* as an authenticated identifier (ACT 118). Specifically, the identifier determination unit 32*a* selects a record in which the "registration ID" in the authenticated genuine product information table 910 is the target identifier. The identifier determination unit 32*a* sets the value indicated by the "authentication situation" of the selected record to the value indicating the "authenticated".

Meanwhile, in ACT 117, the determination result indicates that the target identifier is the cartridge identifier for which the authenticating is previously performed (ACT 117: YES), the processing of ACT 112 is performed.

Third Embodiment

Figure 14:
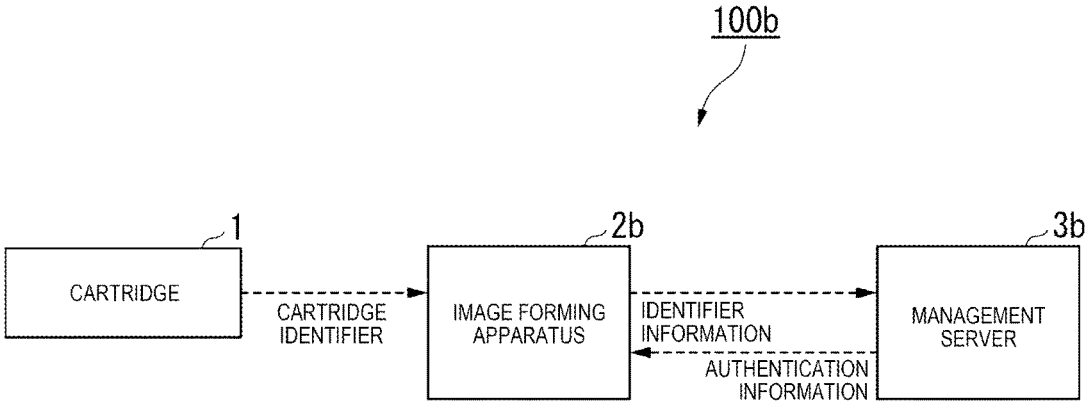
FIG. 14 is a diagram illustrating a specific system configuration diagram of an image forming system according to a third embodiment.

FIG. 14 is a diagram illustrating a specific system configuration of an image forming system 100*b* according to a third embodiment. Hereinafter, functional units having the same functions as the functional units illustrated in FIG. 1 are denoted by the same reference numerals or symbols, and description thereof will be omitted.

The image forming system 100*b* is different from the image forming system 100 in that age forming apparatus 2*b* provided instead of the image forming apparatus 2 and a management server 3*b* is provided instead of the management server 3.

The image forming apparatus 2*b* forms an image using toner supplied by the cartridge 1. The image forming apparatus 2*b* acquires a cartridge identifier for identifying the cartridge 1. The image forming apparatus 2*b* transmits the acquired identifier information to the management server 3*b*.

The management server 3*b* manages the image forming apparatus 2*b*. The management server 3*b* receives the identifier information transmitted by the image forming apparatus 2*b* and manages the image forming apparatus 2*b*, based on the cartridge identifier indicated by the received identifier information. The management server 3*b* acquires the identifier information, performs authenticating, and generates authentication information corresponding to results of the processing.

Figure 15:
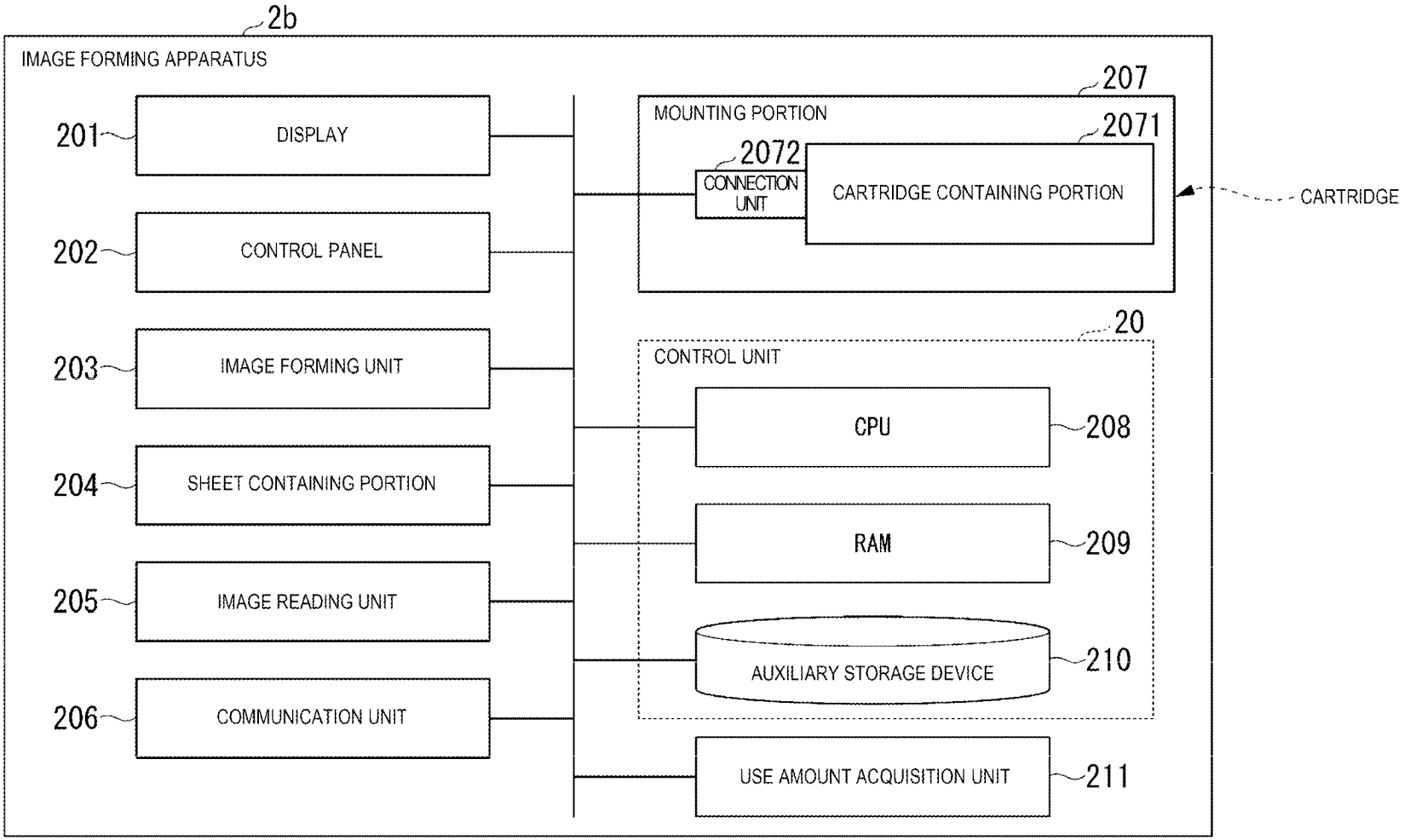
FIG. 15 is a diagram illustrating a specific example of a hardware configuration of an image forming apparatus according to the third embodiment.

FIG. 15 is a diagram illustrating a specific example of a hardware configuration of the image forming apparatus 2*b* according to the third embodiment. The image forming apparatus 2*b* is different from the image forming apparatus 2 in that a use amount acquisition unit 211 is included. Hereinafter, elements having the same functions as the elements illustrated in FIG. 4 are denoted by the same reference numerals or symbols, and description thereof will be omitted.

The use amount acquisition unit 211 acquires the amount of use, which is caused by forming an image, of an object used when an image is formed by the image forming apparatus 2*b*. The object which is used by image formation performed by the image forming apparatus 2*b* is, for example, a sheet on which an image is formed. In this case, the use amount acquisition unit 211 acquires the number of sheets used for forming the image. In addition, the object used by image formation performed by the image forming apparatus 2*b* is, for example, toner. In this case, the use amount acquisition unit 211 acquires the amount of toner used for forming the image.

Hereinafter, description will be made by assuming that the use amount acquisition unit 211 acquires the number of sheets used for forming an image, for the sake of simplicity.

Figure 16:
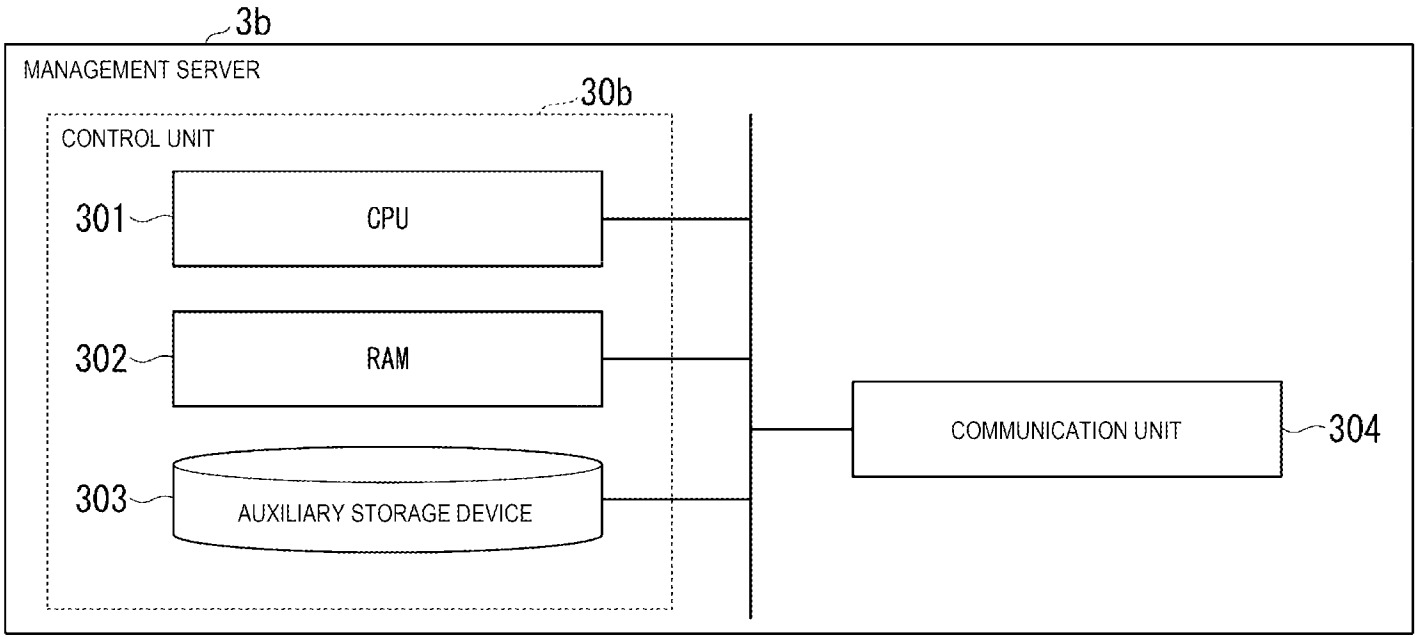
FIG. 16 is a diagram illustrating a specific example of a hardware configuration of a management server according to the third embodiment.

FIG. 16 is a diagram illustrating a specific example of a hardware configuration of the management server 3*b* according to the third embodiment. The management server 3*b* is different from the management server 3 in that a control unit 30*b* is provided instead of the control unit 30.

Figure 17:
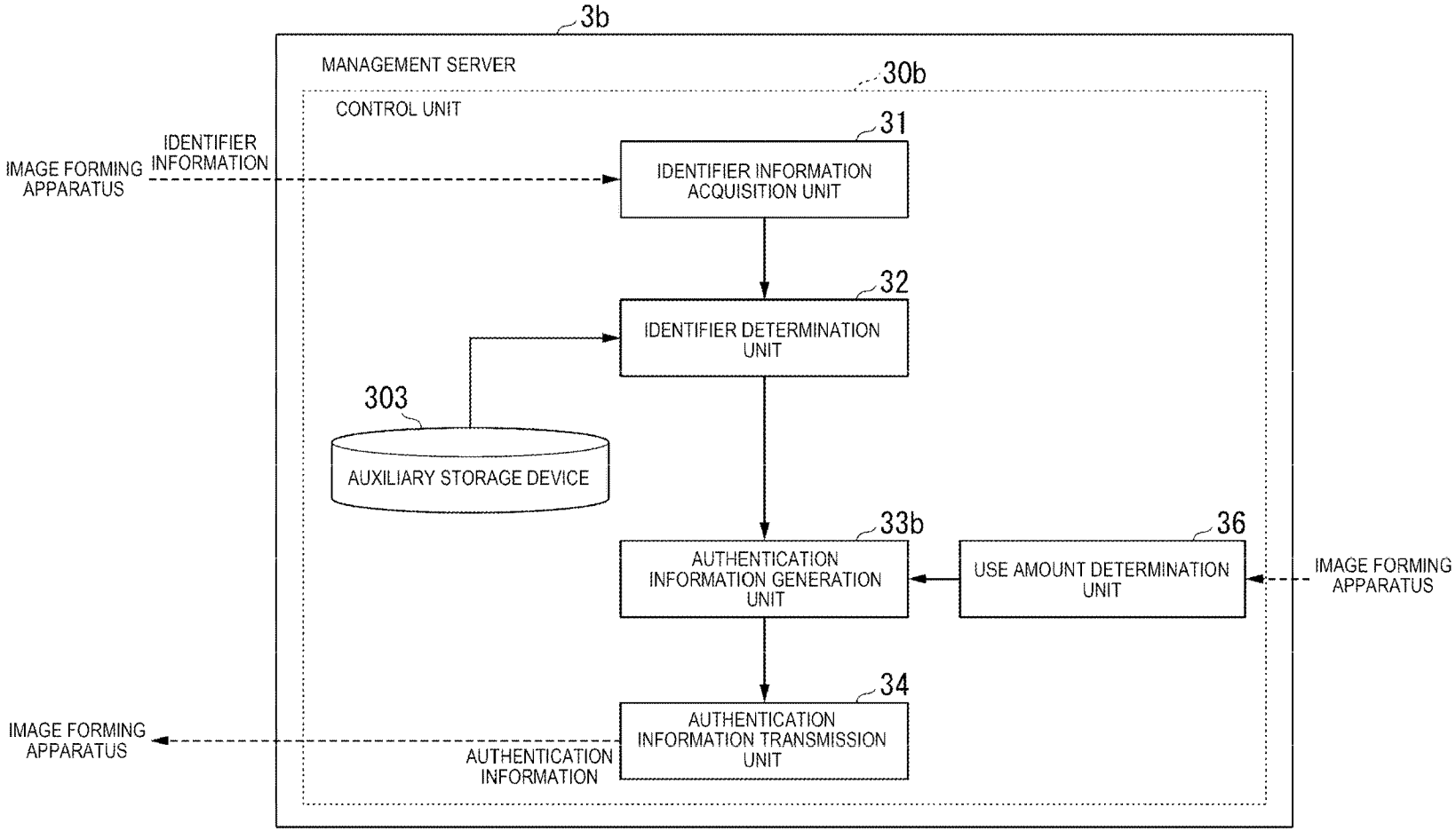
FIG. 17 is a diagram illustrating a specific example of a functional configuration of the management server according to the third embodiment.

FIG. 17 is a diagram illustrating a specific example of functional configuration of the management server 3*b* according to the third embodiment. The management server 3*b* is different from the management server 3 in that an authentication information generation unit 33*b* is provided instead of the authentication information generation unit 33 and a use amount determination unit 36 is provided instead of the time determination unit 35.

The use amount determination unit 36 determines whether or not the number of sheets acquired by the use amount acquisition unit 211 after the image forming apparatus 2 acquires authentication information indicating the temporary permission instruction is greater than a predetermined threshold value.

The authentication information generation unit 33*b* generates authentication information indicating one of a permission instruction, a temporary permission instruction, and a prohibition instruction, based on the determination result of the identifier determination unit 32 and the determination result of the use amount determination unit 36. If a determination result of the genuine product determining performed by the identifier determination unit 32 indicates that the target identifier is not the cartridge identifier of a genuine product, the authentication information generation unit 33*b* generates authentication information indicating the temporary permission instruction. After the authentication information indicating the temporary permission instruction is generated, when the determination result of the use amount determination unit 36 indicates the result indicating that the number of sheets is larger than a predetermined threshold value, the authentication information generation unit 33*b* generates the authentication information indicating the prohibition instruction.

Figure 18:
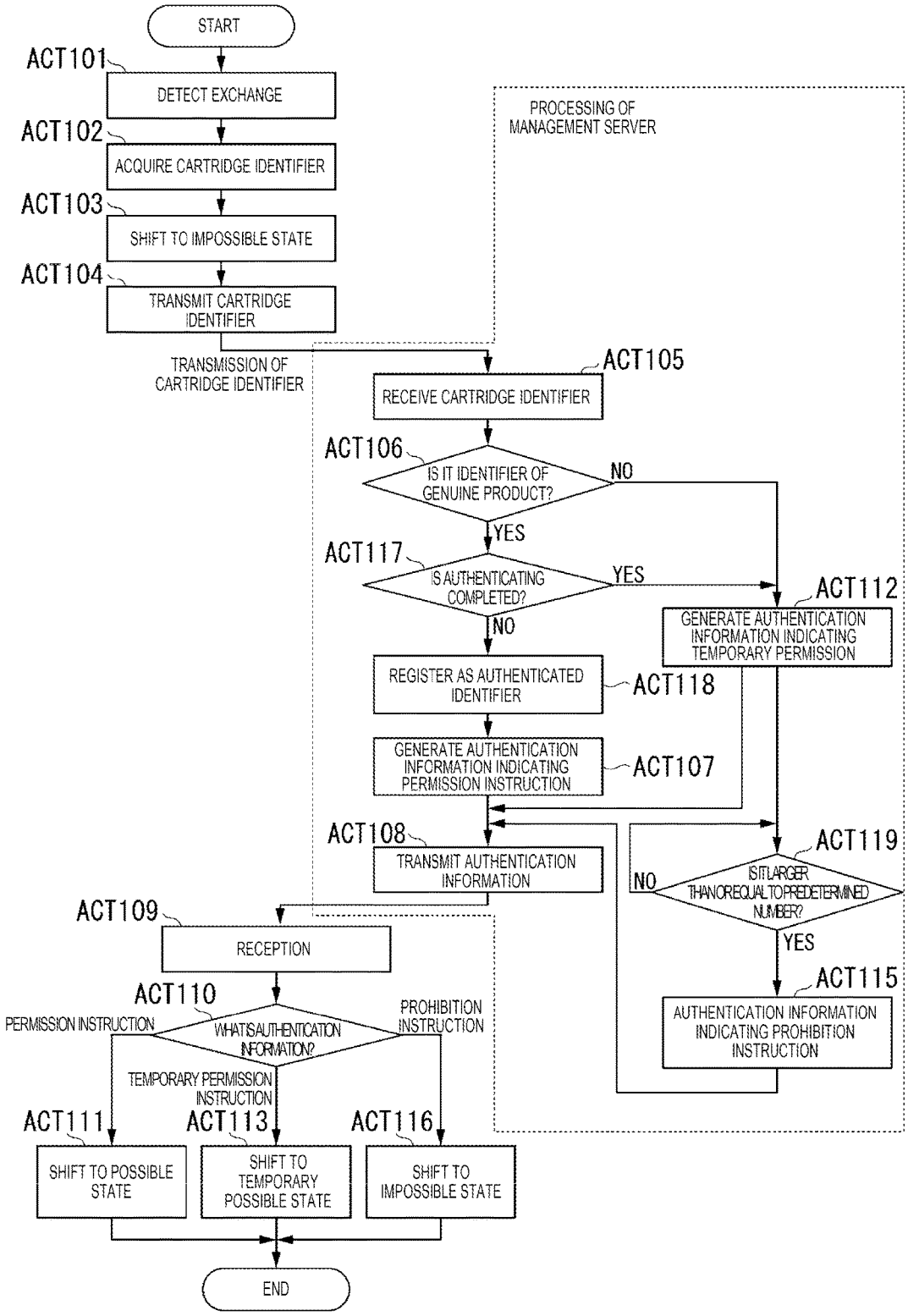
FIG. 18 is a flowchart illustrating a specific example of a flow of processing when replacing a cartridge in the image forming system according to the third embodiment.

FIG. 18 is a flowchart illustrating a specific example of a flow of processing when a cartridge in the image forming system 100*b* according to the third embodiment is exchanged. Hereinafter, the same reference numerals or symbols are attached to the same processing as the processing of FIG. 13, and description thereof will be omitted.

The processing of FIG. 18 is different from the processing of FIG. 13 in that processing ACT 119 is provided instead of the processing of ACT 114.

In ACT 119, the use amount determination unit 36 determines whether or not the number of sheets is greater than a predetermined threshold value. If the number of sheets is larger than the predetermined threshold value (ACT 119: YES), the processing proceeds to ACT 115. If the number of sheets is equal to or less than the predetermined threshold value (ACT 119: NO), the processing of the ACT 119 is periodically repeated thereafter.

Modification Example

Transmission and reception of the cartridge identifier, the identifier information, and the authentication information in the image forming system 100, 100*a* or 100*b* may be performed by being encrypted using a random number. The encryption using the random number may be, for example, a stream encryption.

The cartridge identifier of a genuine product may be an identifier represented by a predetermined mathematical expression. In this case, the cartridge identifiers of a genuine product need not be registered one by one in the auxiliary storage devices 303 and 303*a* in advance, and a mathematical expression indicating the cartridge identifier may be registered.

The identifier determination unit 32 or 32*a* may perform the following invalid identifier recording in ACT 106 of a flow of processing in FIG. 8 or 13. The invalid identifier recording records the cartridge identifier of the cartridge 1 which is a non-genuine product in the auxiliary storage device 303 or 303*a* as an identifier of a non genuine product. The non-genuine product is the cartridges 1 which is not a genuine product. Hereinafter, for the sake of simplicity, a case where the identifier determination unit 32*a* performs the invalid identifier recording in the image forming system 100*a* according to the second embodiment will be described.

Figure 19:
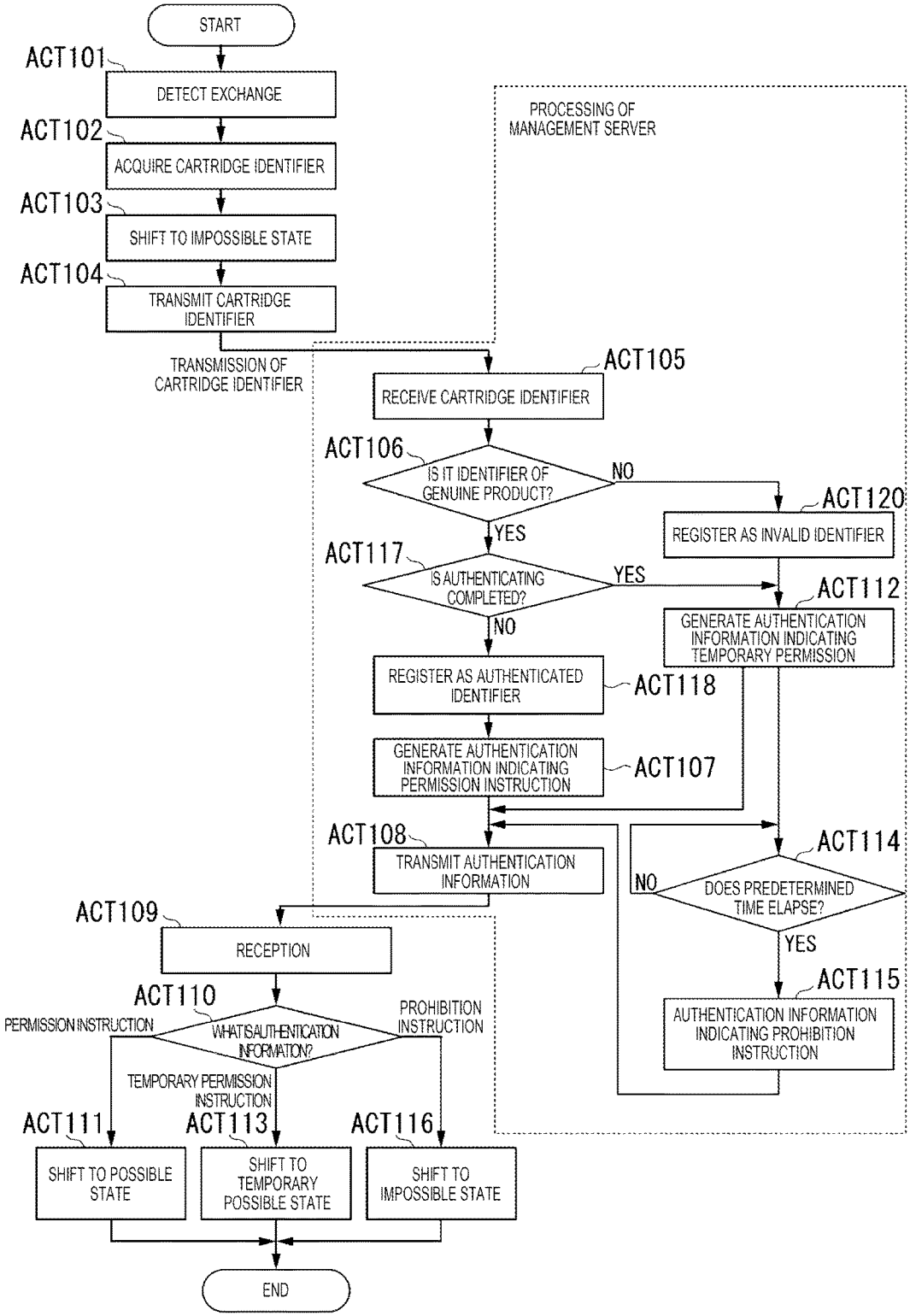
FIG. 19 is a flowchart illustrating a specific example of a flow of processing when replacing a cartridge in an image forming system according to a modification example.

FIG. 19 is a flowchart illustrating a specific example of a flow of processing when a cartridge in the image forming system 100*a* according to the modification example is exchanged. Hereinafter, the same reference numerals or symbols are attached to the same processing as the processing of FIG. 13, and description thereof will be omitted.

Processing of FIG. 19 is different from the processing of FIG. 13 in that ACT 120 is provided. In ACT 106, if the target identifier is not the cartridge identifier of a genuine product (ACT 106: NO), the identifier determination unit 32*a* performs the invalid identifier recording (ACT 120).

All or a part of the respective functions of the image forming apparatuses 2 and 2*b* do not or does not need to be included in one case. All or a part of the respective functions of the image forming apparatuses 2 and 2*b* may be included in, for example, the management servers 3, 3*a* and 3*b*.

All or a part of the respective functions of the management servers 3, 3*a*, and 3*b* do not or does not need to be included in one case. All or a part of the respective functions of the management servers 3, 3*a*, and 3*b* may be included in, for example, the image forming apparatuses 2 and 2*b*.

The identifier determination units 32 and 32*a* are examples of a first determination unit. The time determination unit 35 and the use amount determination unit 36 are examples of a second determination unit. The identifier information acquisition unit 31 is an example of an acquisition unit. The auxiliary storage devices 303 and 303*a* are examples of a storage unit.

All or a part of the respective functions of the cartridge 1, the image forming apparatuses 2 and 2*b*, and the management servers 3, 3*a*, and 3*b* may be realized by using hardware such as an application specific integrated circuits (ASIC), a programmable logic device (PLD), or a field programmable gate array (FPGA). A program may be recorded on a computer readable recording medium. The computer-readable recording medium may be a portable medium such as a flexible disk, a magneto-optical disk, a ROM, or a CD-ROM, or a storage device such as a hard disk built in a computer system. A program may be transmitted via an electric communication line.

According to at least one embodiment described above, the image forming systems 100, 100*a*, and 100*b* enable image formation performed by the image forming apparatus 2 or 2*b* even if the cartridge 1 is not a genuine product. Accordingly, the image forming system 100 configured as described above can maintain image quality and prevent the image forming apparatus from failing, and can improve convenience of a user.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming system comprising:

an image forming unit configured to form an image by using toner supplied by a toner cartridge;

an acquisition unit configured to acquire identification information from the toner cartridge;

a first determination unit configured to determine whether or not the toner cartridge satisfies a first condition, based on the identification information;

a second determination unit configured to determine whether or not a second condition is satisfied when a determination result of the first determination unit indicates that the toner cartridge does not satisfy the first condition; and a controller configured to permit the image forming unit to form an image, when the determination result of the first determination unit indicates that the toner cartridge satisfies a predetermined condition, or when the determination result of the first determination unit indicates that the toner cartridge does not satisfy the predetermined condition and when a determination result of the second determination unit indicates that the second condition is satisfied, wherein the second condition is a time period being within a predetermined period, and wherein the controller is configured to permit the image forming unit to form an image only for the predetermined period when the determination result of the first determination unit indicates that the toner cartridge does not satisfy the predetermined condition.

2. The system according to claim 1, further comprising:

a storage configured to store the identification information of the toner cartridge which is previously determined by the first determination unit, wherein the first determination unit is further configured to determine whether or not the identification information of the toner cartridge is stored in the storage, when the toner cartridge satisfies the first condition, and wherein the controller is configured to permit the image forming unit to form an image only for the predetermined period, based on the determination result of the first determination unit that determines whether or not the identification information of the toner cartridge is stored in the storage.

3. The system according to claim 2, wherein, when the first determination unit determines that the identification information of the toner cartridge is previously stored in the storage, the controller is configured to permit the image forming unit to form an image only for the predetermined period.

4. The system according to claim 1, further comprising:

a storage configured to store identification information of the toner cartridge that does not satisfy the first condition, wherein, when the determination result of the first determination unit indicates that the toner cartridge is not a toner cartridge which satisfies the first condition, the identification information of the toner cartridge is stored in the storage.

5. An image forming method comprising:

forming an image by using toner supplied by a toner cartridge;

acquiring identification information from the toner cartridge;

first determining in a first determination whether or not the toner cartridge satisfies a first condition, based on the identification information;

second determining in a second determination whether or not a second condition is satisfied when a determination result of the first determining indicates that the toner cartridge does not satisfy the first condition; and controlling image formation to be permitted to the image, when a determination result of the first determining indicates that the toner cartridge satisfies a predetermined condition, or when the determination result of the first determining indicates that the toner cartridge does not satisfy the predetermined condition and when a determination result of the second determining indicates that the second condition is satisfied, wherein the second condition is within a predetermined period, and wherein the method further comprises permitting formation of an image only for the predetermined period when the determination result of the first determination indicates that the toner cartridge does not satisfy the predetermined condition.

6. The method according to claim 5, further comprising:

storing the identification information of the toner cartridge which is previously determined by the first determination, wherein the first determination further determines whether or not the identification information of the toner cartridge is stored, when the toner cartridge satisfies the first condition, and permitting formation of an image only for the predetermined period, based on the determination result of the first determination that determines whether or not the identification information of the toner cartridge is stored.

7. The method according to claim 6, further comprising:

when the first determination is that the identification information of the toner cartridge is previously stored in storage, permitting formation of an image only for the predetermined period.

8. The method according to claim 5, further comprising:

storing identification information of the toner cartridge that does not satisfy the first condition, and storing the identification information of the toner cartridge in storage, when the determination result indicates that the toner cartridge is not a toner cartridge which satisfies the first condition.

9. A determination apparatus comprising:

an acquisition unit configured to acquire identification information from a toner cartridge that supplies toner used to form an image, to an image forming unit that forms an image;

a first determination unit configured to determine whether or not the toner cartridge satisfies a first condition, based on the identification information;

a second determination unit configured to determine whether or not a second condition is satisfied when a determination result of the first determination unit indicates that the toner cartridge does not satisfy the first condition; and a controller configured to permit the image forming unit to form an image, when the determination result of the first determination unit indicates that the toner cartridge satisfies a predetermined condition, or when the determination result of the first determination unit indicates that the toner cartridge does not satisfy the predetermined condition and when a determination result of the second determination unit indicates that the second condition is satisfied, wherein the acquisition unit is configured to acquire a predetermined amount that is used in forming an image using the image forming unit, the second condition is a condition in which the predetermined amount that is acquired by the acquisition unit is equal to or less than a predetermined value.

10. The system according to claim 9, wherein the predetermined amount is a number of sheets on which an image is previously formed by the image forming unit, and wherein the controller is configured to permit the image forming unit to form an image, when the determination result of the first determination unit indicates that the toner cartridge does not satisfy the predetermined condition, and only when the number of sheets is equal to or less than a predetermined number.

11. The system according to claim 9, wherein the predetermined amount is an amount of toner used for forming an image by the image forming unit, and wherein the controller is configured to permit the image forming unit to form an image, when the determination result of the first determination unit indicates that the toner cartridge does not satisfy the predetermined condition and only when the amount of toner is equal to or less than the predetermined amount.

* * * * *